US009587492B2

(12) United States Patent
Roberts, III et al.

(10) Patent No.: US 9,587,492 B2
(45) Date of Patent: Mar. 7, 2017

(54) TURBOMACHINE COMPONENT HAVING AN INTERNAL CAVITY REACTIVITY NEUTRALIZER AND METHOD OF FORMING THE SAME

(75) Inventors: Herbert Chidsey Roberts, III, Simpsonville, SC (US); Peter Joel Meschter, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 899 days.

(21) Appl. No.: 13/464,134

(22) Filed: May 4, 2012

(65) Prior Publication Data

US 2013/0291513 A1 Nov. 7, 2013

(51) Int. Cl.
*F01D 5/18* (2006.01)
*F01D 5/14* (2006.01)
*F01D 5/28* (2006.01)

(52) U.S. Cl.
CPC ..... *F01D 5/18* (2013.01); *F01D 5/147* (2013.01); *F01D 5/282* (2013.01); *F01D 5/284* (2013.01); *F01D 5/286* (2013.01); *F05D 2300/224* (2013.01); *F05D 2300/2261* (2013.01); *Y10T 29/49231* (2015.01)

(58) Field of Classification Search
CPC ..... F02C 7/12; Y02T 50/676; F01D 5/147; F01D 5/186; F01D 5/187; F01D 5/288; F01D 25/12; F05D 2230/90; F05D 2260/201; F05D 2260/202
USPC ..... 60/804, 805, 806, 39.091
See application file for complete search history.

(56) References Cited

U.S. PATENT DOCUMENTS

| | | | | |
|---|---|---|---|---|
| 3,994,794 | A | 11/1976 | Bohne | |
| 4,946,570 | A | 8/1990 | Kumar | |
| 6,325,593 | B1 | 12/2001 | Darkins, Jr. et al. | |
| 7,052,238 | B2 | 5/2006 | Whitesell et al. | |
| 7,374,643 | B2 | 5/2008 | Karimzadeh et al. | |
| 8,268,134 | B2 | 9/2012 | Goller et al. | |
| 2004/0121181 | A1 | 6/2004 | Call | |
| 2006/0280952 | A1* | 12/2006 | Hazel et al. | 428/446 |
| 2007/0141464 | A1 | 6/2007 | Huang et al. | |
| 2008/0075593 | A1* | 3/2008 | Read | F01D 5/26 416/95 |

(Continued)

FOREIGN PATENT DOCUMENTS

| | | | |
|---|---|---|---|
| CN | 101481800 | A | 7/2009 |
| CN | 102251246 | A | 11/2011 |

(Continued)

OTHER PUBLICATIONS

J.C. Williams, High Performance Materials Development in the 21st Century: Trends and Directions, Mar. 15, 2004, Materials Science Forum vols. 449-452 (2004) pp. 7-12.*

(Continued)

*Primary Examiner* — Phutthiwat Wongwian
*Assistant Examiner* — Marc Amar
(74) *Attorney, Agent, or Firm* — Fletcher Yoder, P.C.

(57) ABSTRACT

A turbomachine component includes a body having an exterior surface and an interior surface, an internal cavity defined by the interior surface, and a reactivity neutralizing member arranged within the internal cavity. The reactivity neutralizing member is configured and disposed to neutralize turbomachine combustion products on the interior surface of the body.

20 Claims, 2 Drawing Sheets

(56) References Cited

U.S. PATENT DOCUMENTS

| | | | | |
|---|---|---|---|---|
| 2008/0213604 | A1* | 9/2008 | Whiteker et al. | 428/451 |
| 2009/0176110 | A1 | 7/2009 | Pabla et al. | |
| 2009/0220776 | A1 | 9/2009 | Meschter et al. | |
| 2010/0008770 | A1 | 1/2010 | Hazel et al. | |
| 2010/0247321 | A1 | 9/2010 | Kulkarni et al. | |
| 2011/0027098 | A1* | 2/2011 | Noe | C04B 35/573 416/241 B |
| 2011/0064625 | A1 | 3/2011 | Belghazi et al. | |
| 2011/0159175 | A1 | 6/2011 | Groh et al. | |
| 2011/0236222 | A1* | 9/2011 | McFeat | B22C 7/06 416/97 R |
| 2011/0284367 | A1* | 11/2011 | Goller | C23F 13/06 204/196.02 |

FOREIGN PATENT DOCUMENTS

| | | | | |
|---|---|---|---|---|
| EP | 2047979 | A1 | 4/2009 | |
| EP | 2126157 | A2 | 12/2009 | |
| JP | 2011137231 | A | 7/2011 | |
| WO | WO 2009150019 | A1 * | 12/2009 | B22C 7/06 |

OTHER PUBLICATIONS

Baker, Alan Dutton, Stuart Kelly, Donald. (2004). Composite Materials for Aircraft Structures (2nd Edition)—1.8 Hybrid Metal/Pmc Composites, pp. 19-20. American Institute of Aeronautics and Astronautics. Online version available at: http://app.knovel.com/hotlink/pdf/id:kt0046FC51/composite-materials-aircraft/hybrid-metal-pmc-composites.*

Unofficial English Translation of Chinese Office Action issued in connection with corresponding CN Application No. 201310160200.9 on Jul. 3, 2015.

Second Office Action and English Translation; Application No. CN201310160200.9; Dated Feb. 1, 2016; 19 pages.

* cited by examiner

TURBOMACHINE COMPONENT HAVING AN INTERNAL CAVITY REACTIVITY NEUTRALIZER AND METHOD OF FORMING THE SAME

FEDERAL RESEARCH STATEMENT

This invention was made with Government support under Contract Number DE-FC26-05NT42643, awarded by the Department Of Energy. The Government has certain rights in this invention.

BACKGROUND OF THE INVENTION

The subject matter disclosed herein relates to the art of turbomachines and, more particularly, to a turbomachine component having an internal cavity reactivity neutralizer.

Turbomachines include a casing that houses a compressor portion and a turbine portion. The compressor portion includes a number of compressor stages that extend along a flow path. Each compressor stage includes a plurality of compressor blades or buckets that are arranged upstream from a plurality of compressor vanes or nozzles. An airflow passes along the flow path and is compressed to form a compressed airflow. Similarly, the turbine portion includes a number of turbine stages that extend along a hot gas path. Each turbine stage includes a plurality of turbine blades or buckets arranged downstream from a plurality of turbine vanes or nozzles.

A portion of the compressed gases flow to a combustor assembly fluidly connected to each of the compressor portion and turbine portion. The combustor assembly mixes the portion of compressed gases with a combustible fluid to form a combustible mixture. The combustible mixture is combusted in the combustor assembly and passed to the turbine portion through a transition piece. In addition to hot gases from the combustor assembly, gases at a lower temperature flow from a compressor toward a wheelspace of the turbine. The lower temperature gases provide cooling for turbine rotors as well as other internal components of the turbine. As such, many turbomachine components include internal cavities that provide pathways for passing cooling fluid.

BRIEF DESCRIPTION OF THE INVENTION

According to one aspect of the exemplary embodiment, a turbomachine component includes a body having an exterior surface and an interior surface, an internal cavity defined by the interior surface, and a reactivity neutralizing member arranged within the internal cavity. The reactivity neutralizing member is configured and disposed to neutralize turbomachine combustion products on the interior surface of the body.

According to another aspect of the exemplary embodiment, a method of forming a turbomachine component includes forming a turbomachine component having a body including an exterior surface and an interior surface. The interior surface defines an internal cavity. The method also includes positioning a reactivity neutralizing member within the internal cavity.

According to yet another aspect of the exemplary embodiment, a turbomachine includes a compressor portion, a turbine portion operatively connected to the compressor portion, a combustor assembly fluidly connecting the compressor portion and the turbine portion, and a turbomachine component arranged in one of the compressor portion and the turbine portion. The turbomachine component includes a body having an exterior surface and an interior surface, an internal cavity defined by the interior surface, and a reactivity neutralizing member arranged within the internal cavity. The reactivity neutralizing member is configured and disposed to neutralize turbomachine combustion products on the interior surface of the body.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
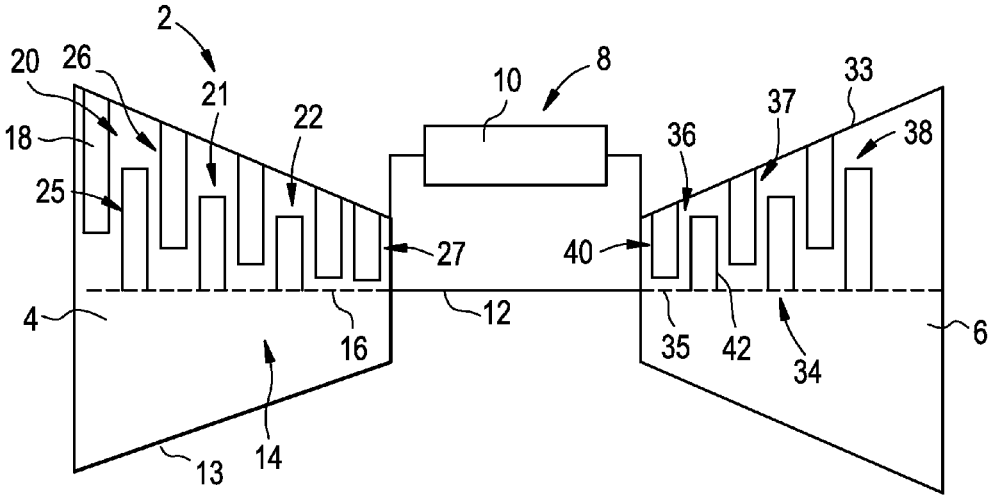
FIG. 1 is a schematic view of a turbomachine having a turbomachine component including an internal cavity reactivity neutralizer in accordance with an exemplary embodiment.

With reference to FIG. 1, a turbomachine constructed in accordance with an exemplary embodiment is illustrated generally at 2. Turbomachine 2 includes a compressor portion 4 fluidly connected to a turbine portion 6. A combustor assembly 8 also fluidly connects compressor portion 4 and turbine portion 6. Combustor assembly 8 includes a plurality of combustors, one of which is shown at 10, arranged in a can-annular array about turbomachine 2. The number and arrangement of combustors may vary.

As shown, compressor portion 4 is mechanically linked to turbine portion 6 through a common compressor/turbine shaft 12. Compressor portion 4 includes a housing 13 that encases a plurality of compressor stages 14 that extend along a fluid path 16. In the exemplary embodiment shown, compressor portion 4 includes an inlet guide vane 18, a first compressor stage 20, a second compressor stage 21, and a third compressor stage 22. First stage 20 includes a plurality of rotating buckets or blades such as shown at 25 arranged upstream from a plurality of stationary vanes or nozzles such as shown at 26. Second and third stages 21 and 22 should be understood to include similar components. Compressor portion 4 is also shown to include an inlet guide vane 27 positioned at an end portion of fluid path 16. Turbine portion 6 includes a housing 33 that encases a plurality of stages 34 that extend along a hot gas path 35. In the exemplary embodiment shown, the plurality of turbine stages 34 of turbine portion 6 includes a first turbine stage 36, a second turbine stage 37 and a third turbine stage 38. First turbine stage 36 includes a plurality of stationary vanes or nozzles 40 arranged upstream from a plurality of rotating buckets or blades 42. Second and third turbine stages 37 and 38 should be understood to include similar structure. Of course it should be understood that the number of stages in both compressor portion 4 and turbine portion 6 could vary.

With this arrangement, air passing into a compressor intake (not separately labeled) flows along fluid path 16 and is compressed through compressor stages 20-22 to form compressed air. A first portion of the compressed air flows into combustor assembly 8, mixes with a combustible fluid, and is then combusted to form combustion gases. The combustion gases expand through turbine stages 36-38 along hot gas path 35 together with a second portion of the compressed gases creating work that is output from turbomachine 2. A third portion of the compressed air passes through turbine portion 6 as a cooling fluid. The cooling fluid passes through hollow regions formed in various components of turbine portion 6. For example, the cooling fluid flows through rotors (not shown), nozzles 40, blades 42 as well as turbine shrouds (also not shown) and other structures. During operation, foreign object damage (FOD) may lead to perforations in the components leading to combustion gases entering into the hollow portions. Prolonged exposure to flow path gases may lead to internal surface erosion that structurally degrades the component(s). As will be discussed more fully below, components of turbomachine 2 are provided with structure that counteracts and/or neutralizes the effects of combustion gases on internal surfaces of various components having hollow portions.

Figure 2:
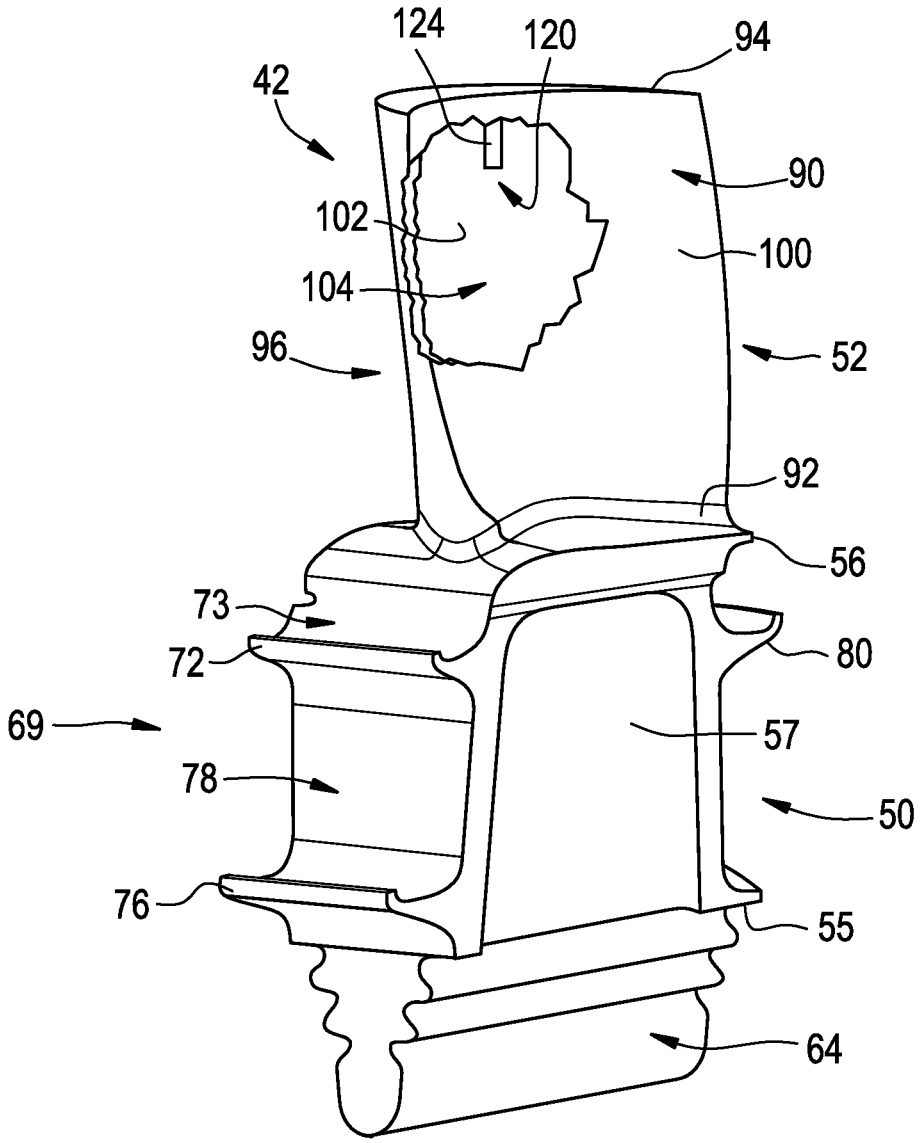
FIG. 2 is a partially cut-away view of an exemplary turbomachine component including an internal cavity reactivity neutralizer in accordance with an exemplary embodiment.

Reference will now be made to FIG. 2 in describing turbine blade 42 constructed in accordance with an exemplary embodiment of the invention. As shown, turbine blade 42 includes a base portion 50 and a blade portion 52. Base portion 50 includes a first end section 55 that extends to a second end section 56 through an intermediate section or shank cavity 57. A mounting member 64 is mounted to base portion 50 at first end section 55. Mounting member 64 serves as an interface between turbine blade 42 and a first stage rotor disk (not shown). In addition, base portion 50 includes a bucket cavity forward region 69 including a first angel wing 72 that extends outward from second end section 56 to define a trench cavity 73. Bucket cavity forward region 69 further includes a second angel wing 76 that also extends outward from second end section 56 to define a buffer cavity 78. A third angel wing 80 extends outward from an opposing side (not separately labeled) of base portion 50. Angel wings 72, 76, and 80 provide structure that prevents, or at least substantially reduces fluid exchanges between hot gas path 35 and a wheel space area (not separately labeled).

Blade portion 52 includes a body 90 having a first end portion 92 that extends from second end section 56 of base portion 50 to a second end or tip portion 94 through an airfoil region 96. Body 90 includes an exterior surface 100 and an interior surface 102. Interior surface 102 defines, at least in part, an internal cavity 104. Internal cavity 104 provides a pathway for cooling gasses to pass through turbine blade 42. In accordance with the exemplary embodiment, turbine blade 42 includes a reactivity neutralizing member 120 positioned within internal cavity 104. Reactivity neutralizing member 120 is formed from a neutralizing material 124 as will be discussed more fully below.

As discussed above, FOD may lead to perforation of blade portion 52 leading to internal surface 102 having a prolonged exposure to combustion or other gases flowing along hot gas path 35. Exposure to gases passing along hot gas path 35 may lead to internal surface 102 erosion. Exposure to oxygen, water vapor, or other corrosive gases may lead to structural damage to turbine blade 42. Uncoated internal cavities (not shown) formed from a silicon carbide/silicon carbide (SiC/SiC) ceramic matrix composite (CMC) material damaged by FOD can lead to an exposure to oxygen which may lead to an eventual loss in fracture toughness resulting from high temperature oxidation: $SiC(s)+3/2O_2(g)= SiO_2(s)+CO(g)$. Uncoated internal cavities exposed to flowing combustion gases as a result of FOD may also or alternatively lead to an exposure to corrosive water vapor, a component of the combustion gases. Combustion gas stream components that may cause structural degradation of interior surfaces of hollow CMC parts include oxygen, carbon dioxide, and water vapor. Internal surfaces of CMC components may be damaged by a reaction with $O_2(g)$ and/or $CO_2(g)$ to form structurally weak $SiO_2$ surface layers, whether or not the component is perforated. $SiO_2$ surface layers also vaporize according to the reaction:

$$SiO_2+2H_2O(g)=Si(OH)_4(g)$$

The rate of the above reaction is much higher if a SiC/SiC ceramic matrix composite material part is perforated. The higher rate of reaction results from both the combustion gas having a higher water vapor partial pressure than the compressor discharge air that would normally flow through the part for cooling purposes, and because the overall gas flow rate is likely to be higher if the part is perforated, at least in the immediate neighborhood of the perforation. The purpose of the reactivity neutralizer 120, which, as will be discussed more fully below, includes Si, is to saturate internal cavity 104 with $Si(OH)_4(g)$ and prevent loss of section thickness of turbine blade 42. Thus reactivity neutralizer 120 takes the form of a sacrificial member. Specifically, neutralizing material 124 is attacked and degraded so that any degradation of interior surface 102 is greatly reduced.

In accordance with one aspect of the exemplary embodiment, interior surface 102 is formed from a SiC/SiC CMC material. In order to neutralize any effects associated with exposure to gases flowing along hot gas path 35, neutralizing material 124 includes silicon (Si). As discussed above, Si will react with the gases flowing along gas path 35. The presence of reactivity neutralizing member 120 within internal cavity 104 will protect interior surface 102 from the effects of exposure to the gases flowing along gas path 35. At this point it should be understood that neutralizing material 124 may vary depending upon the material which forms interior surface 102. If interior surface 102 is formed from an organic material such as a polymer matrix composite (PMC), the neutralizing material 124 may take the form of graphite or carbon. In addition, it should be understood that while described in terms of being placed in a turbine blade, reactivity neutralizing member 120 may be incorporated into other turbine components such as vanes, shrouds, rotors and the like. Reactivity neutralizing member 120 may also be incorporated into compressor components.

Furthermore, it should be understood that reactivity neutralizing member 120 may be replaceable during maintenance of turbomachine 2. It should also be understood that reactivity neutralizing member 120 may be positioned adjacent to one or more areas that are considered to be most likely to be perforated, and/or that reactivity neutralizing member 120 is provided with a relatively large surface to volume ratio in order to further protect interior surface 102. Regardless of the material of construction of a component such as turbine blade 42, the addition of a reactivity neutralizer material into an internal cavity of the component increases the mean service life and thus lowers life cycle cost of the component in a challenging environment. Adding a replaceable reactivity neutralizer leads to the conservation of precious material resources needed to maintain the structural integrity of the component. Further, it should be understood that neutralizing material 124 may vary to accommodate the material employed in the formation of turbine blade 42. In components fabricated from polymer matrix composites (PMC's) neutralizing material 124 may include C to sacrificially protect the carbon (C) component of the PMC from vaporization of the internal cavity surfaces.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A turbomachine component for a turbomachine, comprising: a body having an exterior surface and an interior surface; an internal cavity defined by the interior surface; and a replaceable reactivity neutralizing member arranged within the internal cavity, wherein the replaceable reactivity neutralizing member comprises a first and opposite a second end, and wherein the first end of the replaceable reactivity neutralizing member is coupled to the interior surface of the body and the second end is a free end disposed within the internal cavity, and wherein the replaceable reactivity neutralizing member is configured to neutralize turbomachine combustion products on the interior surface of the body, wherein the replaceable reactivity neutralizing member extends from a free end of the turbomachine component towards a central axis of the turbomachine.

2. The turbomachine component according to claim 1, wherein the interior surface is formed from a ceramic based material.

3. The turbomachine component according to claim 2, wherein the ceramic material is a silicon carbide/silicon carbide (SiC/SiC) ceramic composite matrix (CMC) material.

4. The turbomachine component according to claim 3, wherein the replaceable reactivity neutralizing member comprises silicon (Si).

5. The turbomachine component according to claim 1, wherein the interior surface is formed from a polymer matrix composite (PMC) based material.

6. The turbomachine component according to claim 5, wherein the replaceable reactivity neutralizing member comprises carbon (C).

7. The turbomachine component according to claim 1, wherein the turbomachine component is one of a turbine bucket, a turbine nozzle, and a turbine shroud member.

8. A method of forming a turbomachine component for a turbomachine, the method comprising: forming a turbomachine component having a body including an exterior surface and an interior surface, the interior surface defining an internal cavity; and positioning a replaceable reactivity neutralizing member within the internal cavity, wherein the replaceable reactivity neutralizing member comprises a first end opposite a second end, and wherein the first end of the replaceable reactivity neutralizing member is coupled to the interior surface of the body and the second end is a free end disposed within the internal cavity, and wherein the replaceable reactivity neutralizing member is configured to neutralize turbomachine combustion products on the interior surface of the body, wherein the replaceable reactivity neutralizing member extends from a free end of the turbomachine component towards a central axis of the turbomachine.

9. The method of claim 8, wherein forming the turbomachine component includes forming a turbine component formed from a ceramic material.

10. The method of claim 9, wherein forming the turbine component from a ceramic material includes forming the turbine component from a silicon carbide/silicon carbide ceramic matrix composite (CMC) material.

11. The method of claim 9, wherein positioning the replaceable reactivity neutralizing member includes positioning a reactivity neutralizing member comprising silicon (Si) within the internal cavity.

12. The method of claim 8, wherein forming the turbomachine component includes forming a turbine component from a polymer matrix composite (PMC) based material.

13. The method of claim 12, wherein positioning the replaceable reactivity neutralizing member includes providing a reactivity neutralizing member comprising carbon (C) within the internal cavity.

14. The method of claim 8, wherein forming a turbomachine component includes forming one of a turbine bucket, a turbine nozzle, and a turbine shroud.

15. A turbomachine component for a turbomachine, comprising: a compressor portion; a turbine portion operatively connected to the compressor portion; a combustor assembly fluidly connecting the compressor portion and the turbine portion; and the turbomachine component arranged in the turbine portion, the turbomachine component comprising: a body having an exterior surface and an interior surface; an internal cavity defined by the interior surface; and a replaceable reactivity neutralizing member arranged within the internal cavity; wherein the replaceable reactivity neutralizing member comprises a first end opposite a second end, and wherein the first end of the replaceable reactivity neutralizing member is coupled to the interior surface of the body and the second end is a free end disposed within the internal cavity, and wherein the replaceable reactivity neutralizing member is configured to neutralize turbomachine combustion products on the interior surface of the body, and wherein the replaceable reactivity neutralizing member extends from a free end of the turbomachine component towards a central axis of the turbomachine.

16. The turbomachine component for the turbomachine according to claim 15, wherein the interior surface is formed from a silicon carbide/silicon carbide (SiC/SiC) ceramic composite matrix (CMC) material.

17. The turbomachine component for the turbomachine according to claim 16, wherein the replaceable reactivity neutralizing member comprises silicon (Si).

18. The turbomachine component for the turbomachine according to claim 15, wherein the interior surface is formed from a polymer matrix composite (PMC) based material.

19. The turbomachine component for the turbomachine according to claim 18, wherein the replaceable reactivity neutralizing member comprises carbon (C).

20. The turbomachine component for the turbomachine according to claim 15, wherein the turbomachine component is one of a turbine bucket, a turbine nozzle, and a turbine shroud member.

* * * * *